US010400508B1

(12) United States Patent
Cito

(10) Patent No.: US 10,400,508 B1
(45) Date of Patent: Sep. 3, 2019

(54) DEPLOYABLE SCREEN MODULE FOR A WINDOW SASH

(71) Applicant: John Cito, Lincroft, NJ (US)

(72) Inventor: John Cito, Lincroft, NJ (US)

( * ) Notice: Subject to any disclaimer, the term of this patent is extended or adjusted under 35 U.S.C. 154(b) by 204 days.

(21) Appl. No.: 15/629,534

(22) Filed: Jun. 21, 2017

(51) Int. Cl.

| | |
|---|---|
| ***E06B 9/54*** | (2006.01) |
| ***E06B 9/60*** | (2006.01) |
| ***E06B 9/64*** | (2006.01) |
| ***E06B 3/44*** | (2006.01) |
| *E06B 9/52* | (2006.01) |

(52) U.S. Cl.
CPC ..... *E06B 9/54* (2013.01); *E06B 3/4415* (2013.01); *E06B 9/60* (2013.01); *E06B 9/64* (2013.01); *E06B 2009/527* (2013.01); *E06B 2009/528* (2013.01)

(58) Field of Classification Search
CPC ..... E06B 9/54; E06B 9/60; E06B 9/64; E06B 9/52; E06B 9/40; E06B 2009/527; E06B 2009/528; E06B 2003/4492; E06B 3/4415
USPC ..... 160/30
See application file for complete search history.

(56) References Cited

U.S. PATENT DOCUMENTS

| | | | | | |
|---|---|---|---|---|---|
| 2,012,124 | A * | 8/1935 | Feige | E06B 9/54 | 160/23.1 |
| 2,243,790 | A * | 5/1941 | Blood | A47H 99/00 | 160/30 |
| 2,539,122 | A * | 1/1951 | Ditta | E06B 9/54 | 160/30 |
| 2,553,868 | A * | 5/1951 | Piva, Jr. | E06B 9/54 | 160/245 |
| 2,560,440 | A * | 7/1951 | Heeren | E06B 9/54 | 160/30 |
| 2,605,823 | A * | 8/1952 | Lockhart | E06B 9/54 | 160/30 |
| 2,825,400 | A * | 3/1958 | Poulsen | E06B 9/54 | 160/30 |
| 4,862,942 | A * | 9/1989 | Johnson | E06B 9/54 | 160/99 |
| 5,915,443 | A * | 6/1999 | Lindley, Jr. | E06B 9/54 | 160/100 |
| 6,167,936 | B1 * | 1/2001 | Stover | E06B 9/54 | 160/100 |
| 6,470,947 | B1 * | 10/2002 | Holevas | E06B 7/03 | 160/100 |
| 6,499,527 | B1 * | 12/2002 | Lindley, Jr. | E06B 9/40 | 160/271 |
| 7,080,676 | B2 * | 7/2006 | Abelson | E06B 9/54 | 160/30 |
| 7,703,498 | B2 * | 4/2010 | Holevas | E06B 9/60 | 160/100 |
| 7,819,167 | B2 * | 10/2010 | Morin | E06B 7/03 | 160/102 |
| 9,022,089 | B1 * | 5/2015 | Dau | E06B 9/54 | 160/30 |
| 9,932,769 | B2 * | 4/2018 | Woolery | E06B 9/54 | |
| 2007/0199665 | A1 * | 8/2007 | Studney | A47H 99/00 | 160/99 |

(Continued)

*Primary Examiner* — Beth A Stephan
(74) *Attorney, Agent, or Firm* — Edwin D. Schindler

(57) ABSTRACT

A tilt window having sash with an internal screen that deploys when the sash is opened and retracted when the sash is closed with a cleaning mechanism in the form of a brush lined slot engaging the screen as it moves into and out of the sash receptacle.

6 Claims, 8 Drawing Sheets

(56) References Cited

U.S. PATENT DOCUMENTS

| | | | | |
|---|---|---|---|---|
| 2013/0098566 | A1* | 4/2013 | Horvath | E06B 9/58<br>160/273.1 |
| 2014/0251553 | A1* | 9/2014 | Farntrog | E06B 9/52<br>160/99 |

* cited by examiner

DEPLOYABLE SCREEN MODULE FOR A WINDOW SASH

BACKGROUND OF THE INVENTION

The present invention relates generally to windows and, more specifically, to a window sash having an internal screen that deploys through a brush lined slot cleaning the screen as the sash is opened and closed.

SUMMARY OF THE INVENTION

The primary object of the present invention is to provide a screen for a window that is not visible until a window sash is opened.

Another object of the present invention is to provide a screen module for non-tilt sash windows and tilt sash windows.

Yet another object of the present invention is to provide the screen module as an integral part of or releasably fixed to or within the body of a top sash and/or bottom sash of a window.

Still yet another object of the present invention is to deploy the screen from the screen module as the sash is opened and retract the screen as the sash is closed.

An additional object of the present invention is to provide a sash-tilt window screen module with a housing having distal end mounting brackets.

A further object of the present invention is to provide a sash-tilt window screen module with angled mounting brackets allowing the screen to marginally engage the window's left and right sash tracks to prevent insect ingress.

A yet further object of the present invention is to further provide a sash-tilt window screen module housing having a slot as passage for extending and retracting the screen.

A still yet further object of the present invention is to provide a sash-tilt window screen module further comprising a brush positioned approximate to the screen-passage slot brushing the screen clean as the screen deploys and retracts from the housing.

Another object of the present invention is to provide a sash-tilt window screen-module having a screen holder linked to a screen tensioning member keeping the screen substantially rigid when deployed and retracting the screen onto the holder as the sash is closed.

Yet another object of the present invention is to provide a sash-tilt window screen module having the screen mounted on a tube with the tube having an internal spring fixedly attached at one end to a non rotating housing member and the rotatable tube.

Still yet another object of the present invention is to clean the screen as it deploys and retracts from the housing passing through the housing longitudinal slot using one or more brushes positioned approximate the slot.

Still yet another object of the present invention is to clean the screen as it deploys and retracts from the housing passing through the housing longitudinal slot using one or more polymeric or elastomeric blades positioned approximate the slot.

The foregoing and related objects are accomplished by the present invention, in which a window sash is provided with an internal screen that deploys through a brush lined slot when the sash is opened and when retracted with the brush lined slot cleaning the screen as it moves in and out of its stored location.

More particularly, the present invention provides a window sash having a pair of spaced apart stiles and rails conjoined on their distal ends with a rail having receptacle for a screen module, which includes a housing having base with a longitudinal slot as passage for screen brush positioned approximate the slot for engaging the screen to remove debris while passing through the slot screen mounted on a holder having an anchored end and a free end. The free end is preferably releasably latchable to a window sill, thereby deploying and retracting the screen as the sash is raised and lowered; the holder having a tensioning member storing the pressure of the deploying screen then used to retract the screen as the sash is raised and lowered.

It is particularly desirable to provide a window sash with an integral screen module that deploys and retracts the screen as the window sash is opened and closed.

It is further desirable to provide the screen module with brushes that brush the screen clean as it moves into, and out of, its stored position.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

DESCRIPTION OF THE REFERENCED NUMERALS

Turning now descriptively to the drawings, in which similar reference characters denote similar elements throughout the several views, the figures illustrate the use of the present invention. With regard to the reference numerals used, the following numbering is used throughout the various drawing figures.

10 window of the present invention
12 window prior art
14 rigid screen
16 window sash
18 sash stile
22 sash rail
24 meeting rail
26 sash lock
28 tilt latch
30 sash channel
32 sash pivot pin
34 window jamb channel
36 counterbalance shoe
38 slide lock of 36
40 sill
42 sash cavity
44 screen module
46 screen module housing
48 housing mounting bracket
52 housing screen aperture
54 brush of 52
56 housing bracket apertures of 44
58 screen holder
62 screen
64 screen tensioner
66 screen anchor
68 screen sill latch
70 tensioner anchor
72 weather stripping

BRIEF DESCRIPTION OF THE DRAWING FIGURES

In the drawing figures, wherein similar features are denoted with similar reference numerals throughout the several views.

DETAILED DESCRIPTION OF THE DRAWING FIGURES AND PREFERRED EMBODIMENTS

The following discussion describes in detail one embodiment of the invention and several variations of the preferred embodiment. This discussion should not be construed, however, as limiting the invention to those particular embodiments, practitioners skilled in the art will recognize numerous other embodiments as well. For definition of the complete scope of the invention, the reader is directed to appended claims.

Figure 1A:
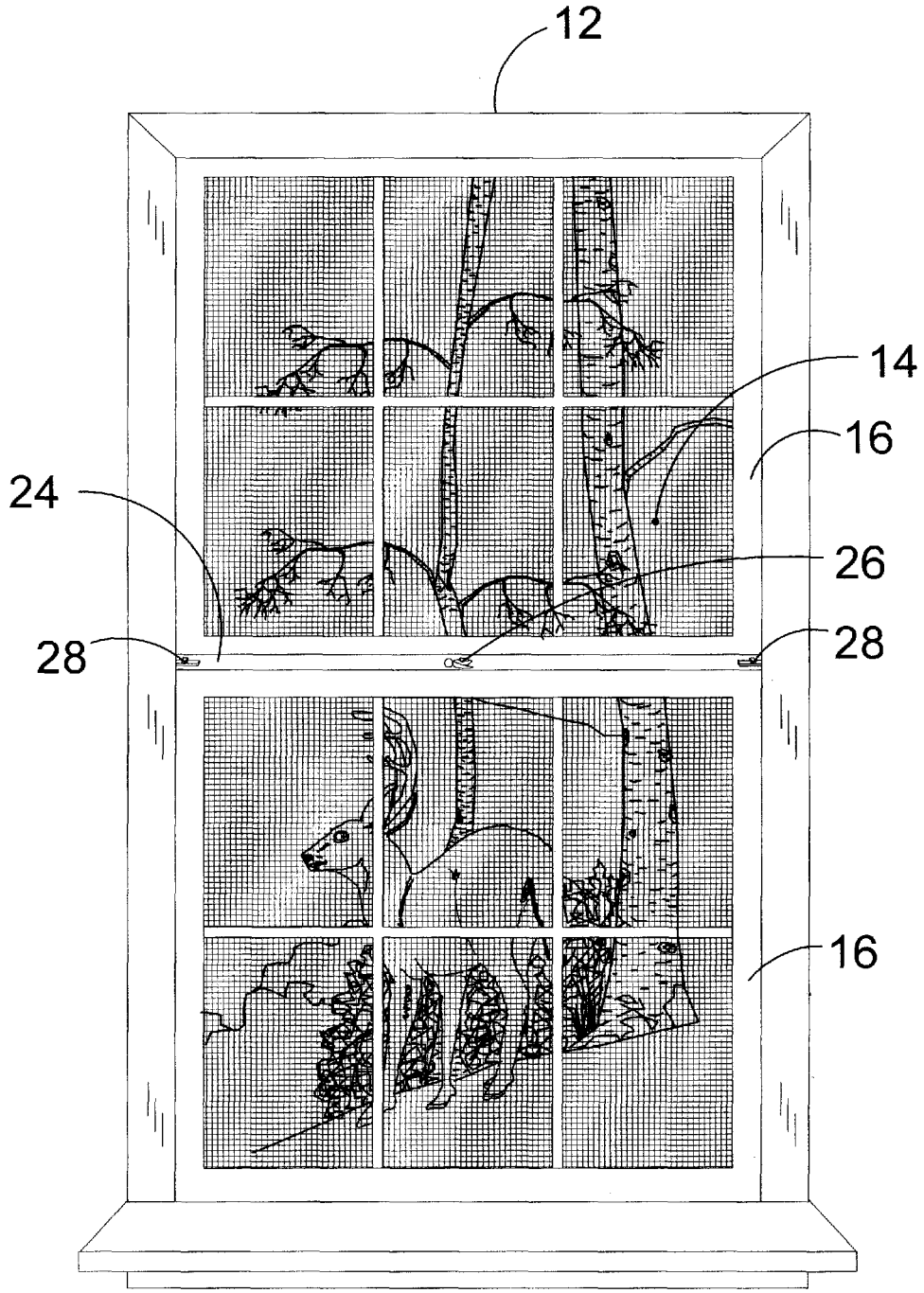
FIG. 1A (PRIOR ART)
FIG. 1A is a window of the prior art.

Referring to FIG. 1A, shown is a window of the prior art. Illustrated is a tilt window 12 comprising upper sash 16, lower sash 16 and meeting rail 24 having sash lock 26 and tilt latches 28. Also shown is the ubiquitous rigid screen 14 affecting the view and aesthetic appearance of the window. The present invention envisions a screen within the lower sash and/or upper sash that deploys when the lower sash is raised or the upper sash is lowered and retracts when returned to its closed position.

Figure 1B:
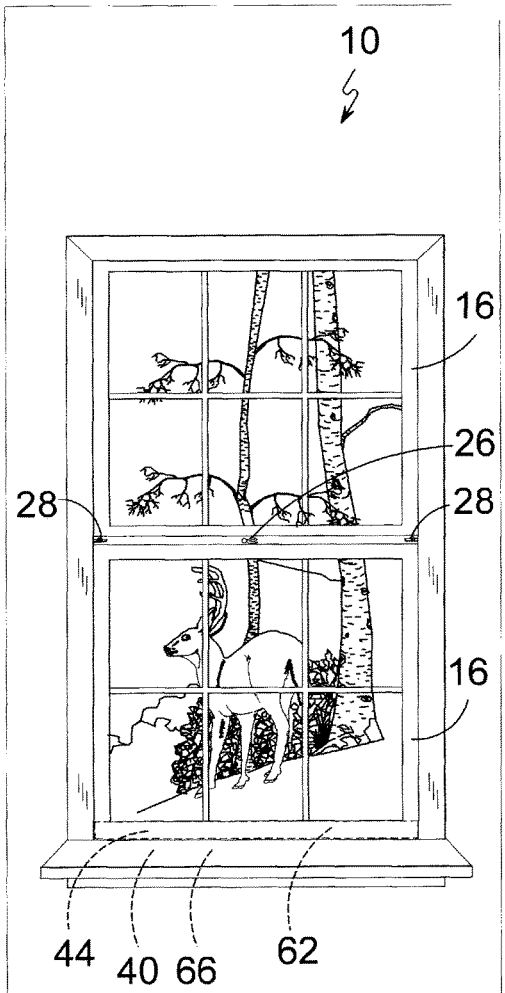
FIG. 1B is the window of the present invention with the screen hidden from view.
Figure 1C:
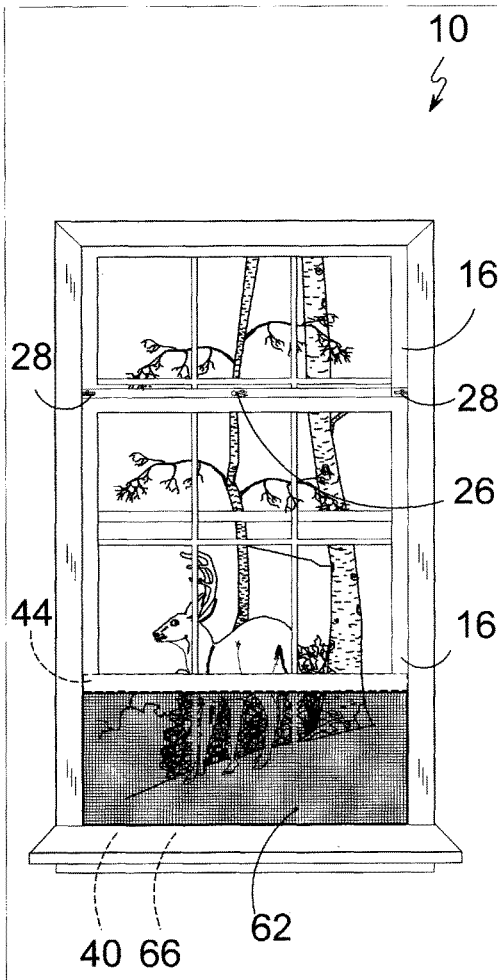
FIG. 1C is the window of the present invention with the screen deployed.

Referring to FIGS. 1B and 1C, shown is the window of the present invention with the screen hidden from view and viewable. The present invention provides a window 10 having sill 40, upper sash 16, lower sash 16 having tilt latches 28 and sash lock 26 with the bottom rail having screen module 44 housing screen 62 and screen anchor 66. FIG. 1B shows the sash closed adding to the view and the window's aesthetic appearance. FIG. 1C depicts the sash open with screen anchor 66 releasably attached to sill 40 causing screen 62 to be deployed when the sash is open.

Figure 2:
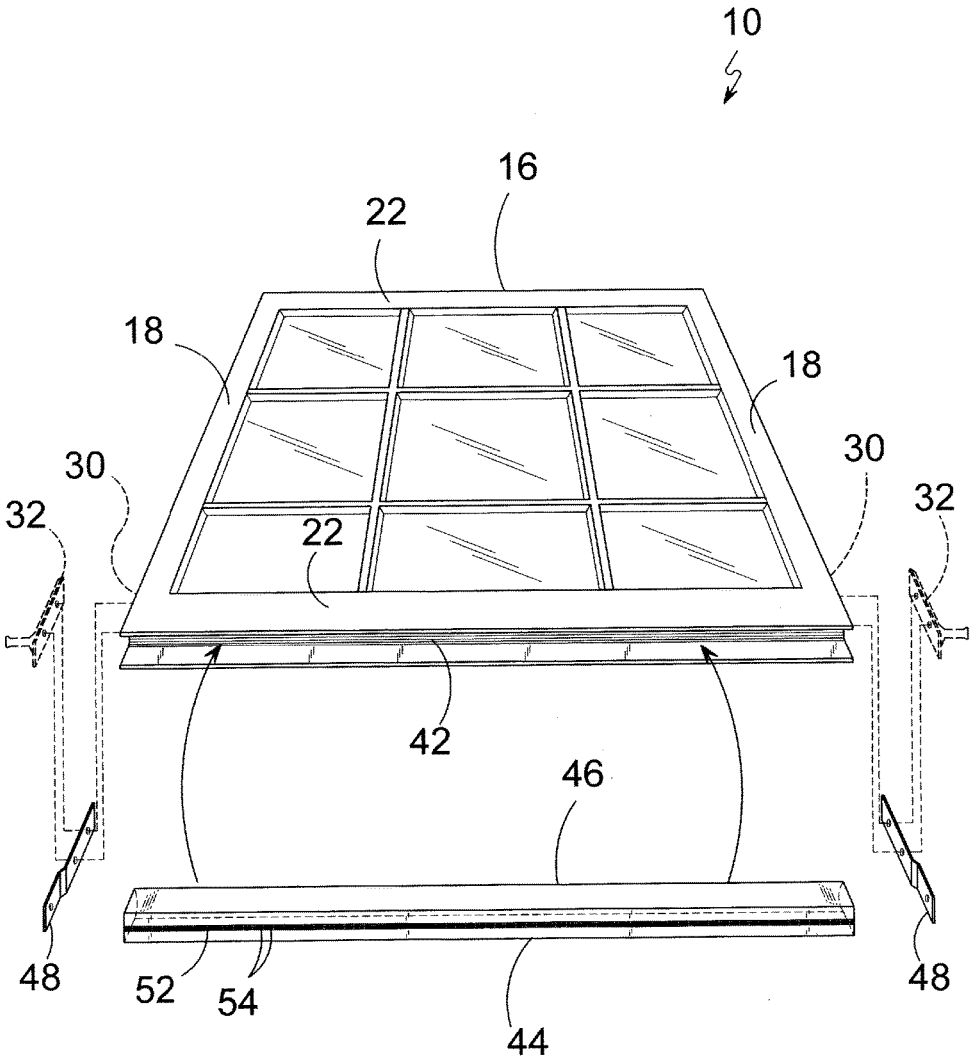
FIG. 2 is an exploded view of the sash of the present invention.

Referring to FIG. 2, shown is an exploded view of the sash of the present invention. Sash 16 having stiles 18 and rails 22 with one of said rails having cavity 42 and sash channels 30 forming receptacle for screen module 44 and housing mounting brackets 48. Screen module 44 comprises housing 46 having a base with longitudinal slot 52 lined with brush 54 that engages screen 62 when deploying from and retracting into housing 46. Angled bracket 48 has a double bend with two fastener surfaces. One fastener surface is positioned subjacent the pivot pin 32 with the other pair of fastening surfaces fastened to the screen module housing.

Figure 3A:
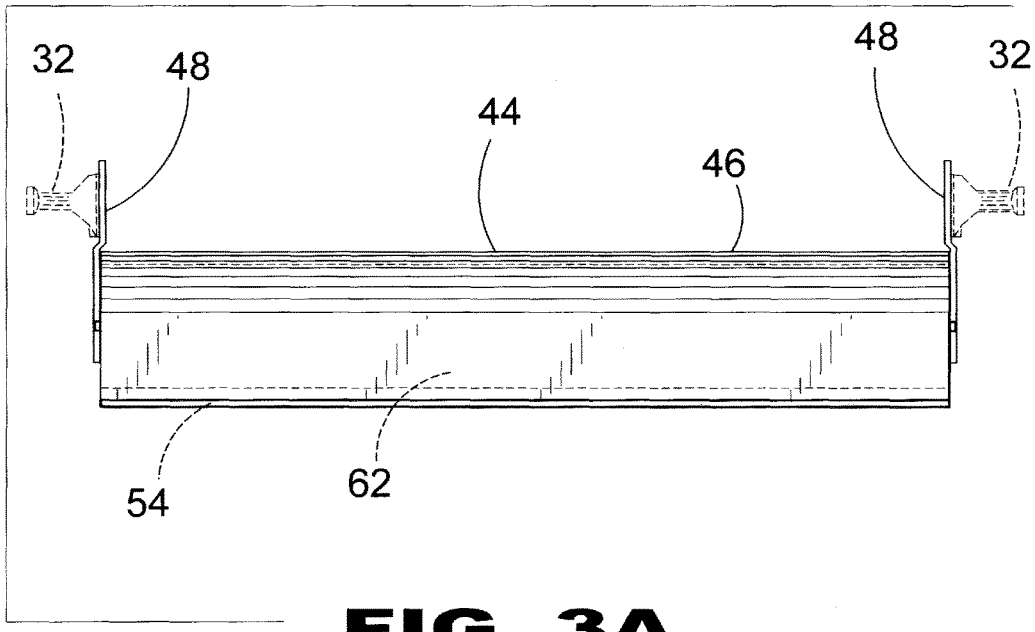
FIG. 3A is a side view of the screen module for a tiltable sash incorporating deployable sash screen.
Figure 3B:
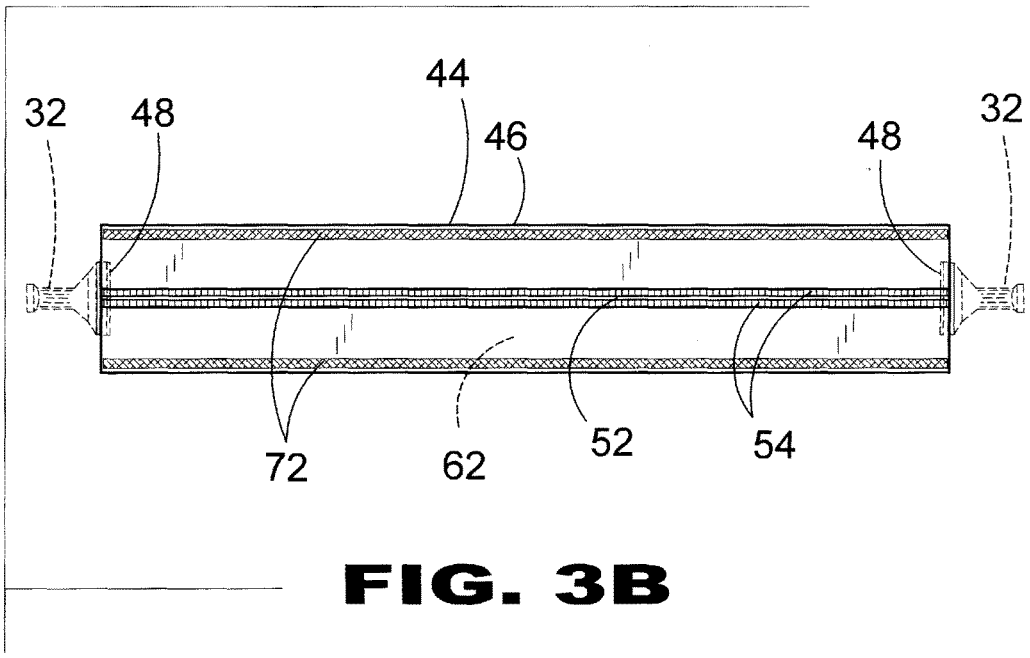
FIG. 3B is a bottom view of the screen module for a tiltable sash incorporating deployable sash screen.

Referring to FIG. 3, shown are an illustrative side and bottom view of the screen module for a tiltable sash incorporating deployable sash screen. FIG. 3A depicts the screen module 44 having housing 46 that is fixedly attached within a sash cavity 42 via bracket 48 fastened to housing 46 and subjacent pivot pin 32 pivot pins. FIG. 3B depicts a bottom view showing longitudinal slot 52 having brush 54 for cleaning the screen as it deploys from and retracts into housing 46. Also shown is weather stripping 72 thereby sealing the bottom sash from air leaks.

Figure 4:
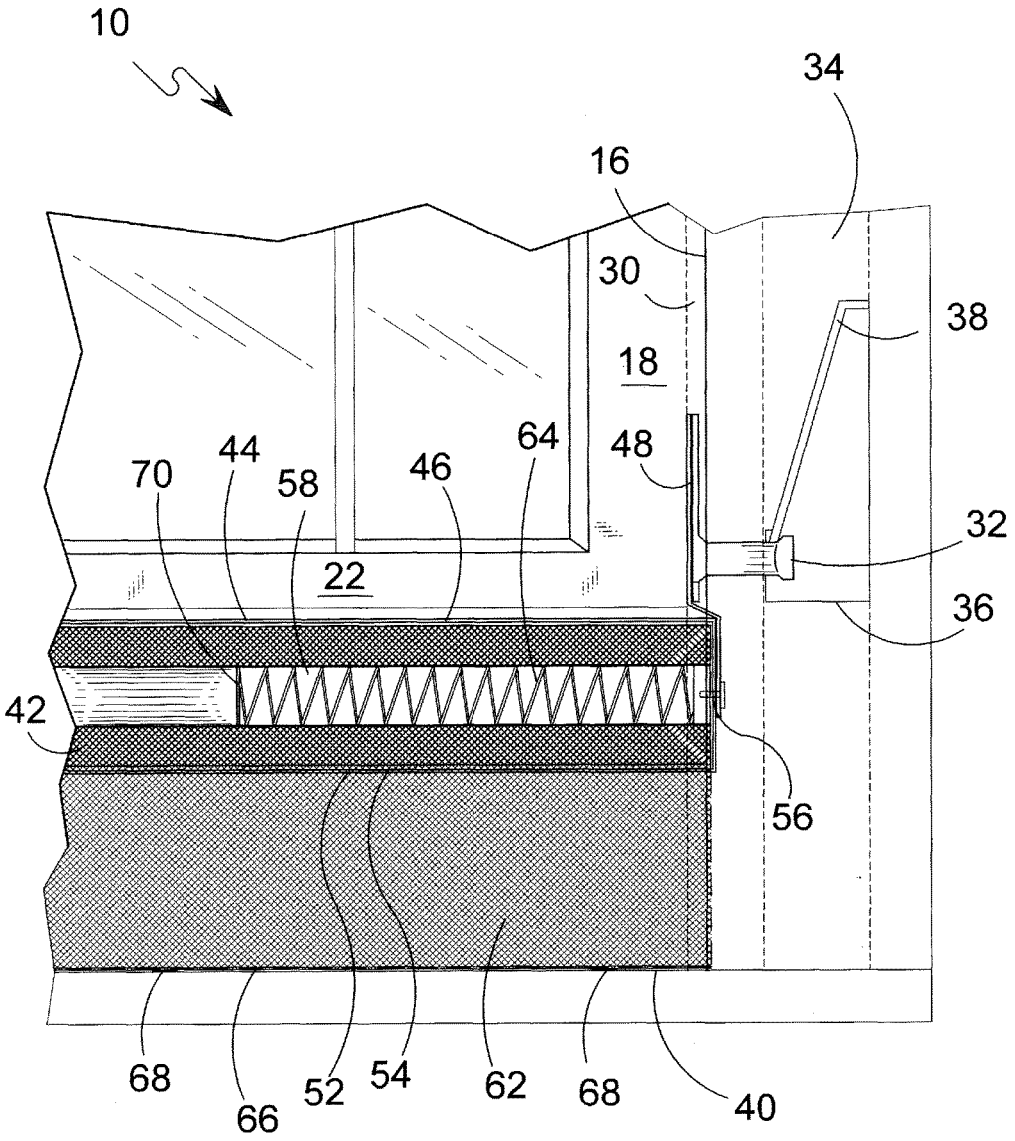
FIG. 4 is a cutaway view of the sash and screen module.

Referring to FIG. 4, shown is a cutaway view of the sash and screen module. Sash 16 has stiles 18 and rails 22 mounted within a window frame with the stiles having sash channel 30 as receptacle for pivot pin 32 extending into window jamb channel 34 engaging counterbalance shoe 36 having slide lock 38 positioned within window jamb channel 34. One of the sash rails 22 having cavity 42 serving as receptacle for screen module 44 having housing 46 with a base having longitudinal slot 52 lined with brush 54 that engages screen 62 when deploying from and retracting into housing 46. Sash channels 30 is receptacle for housing mounting brackets 48 positioned subjacent the pivot pin 32 with the other pair of fastening surfaces fastened to the screen module housing. Screen 62 is mounted onto holder 58 having screen tensioner 64 shown as a longitudinal spring having anchor 70 with holder 58 and non-rotative anchor with housing 46. Pressure from screen deploying/holder rotation is stored in the spring with the pressure released as the screen is retracted.

Figure 5:
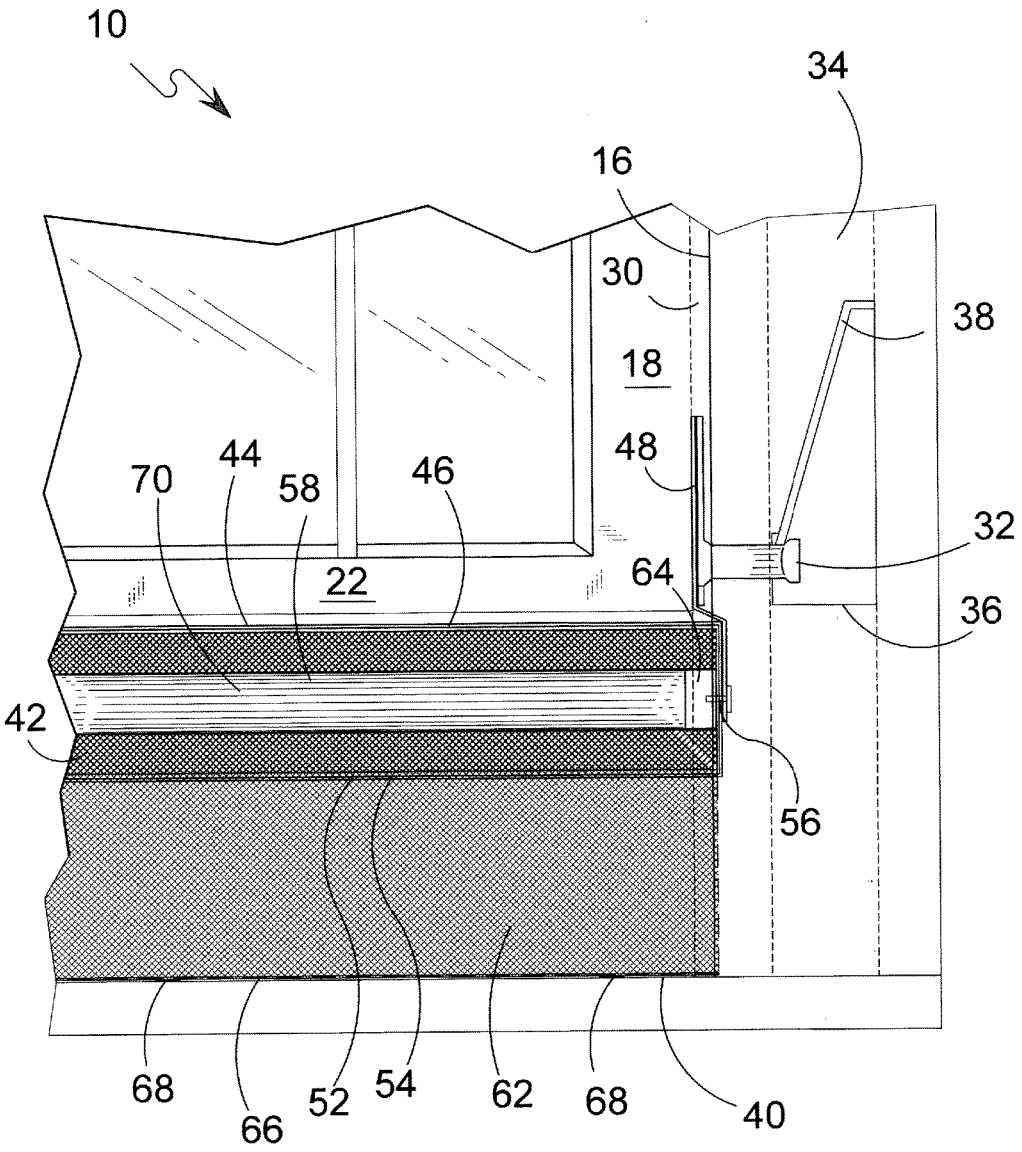
FIG. 5 is an additional cutaway view of the sash and screen module.

Referring to FIG. 5, shown is a cutaway view of the sash and screen module. As aforementioned, sash 16 has stiles 18 and rails 22 mounted within a window frame with the stiles having sash channel 30 as receptacle for pivot pin 32 extending into window jamb channel 34 engaging counterbalance shoe 36 having slide lock 38 positioned within window jamb channel 34. One of the sash rails 22 having cavity 42 serving as receptacle for screen module 44 having housing 46 with a base having longitudinal slot 52 lined with brush 54 that engages screen 62 when deploying from and retracting into housing 46. Sash channels 30 is receptacle for housing mounting brackets 48 positioned subjacent the pivot pin 32 with the other pair of fastening surfaces fastened to the screen module housing. Screen 62 is mounted onto holder 58 having screen tensioner 64 as a coiled spring (see FIG. 6). Pressure from the screen deploying/holder rotation is stored in the spring with the pressure released as the screen is retracted.

Figure 6:
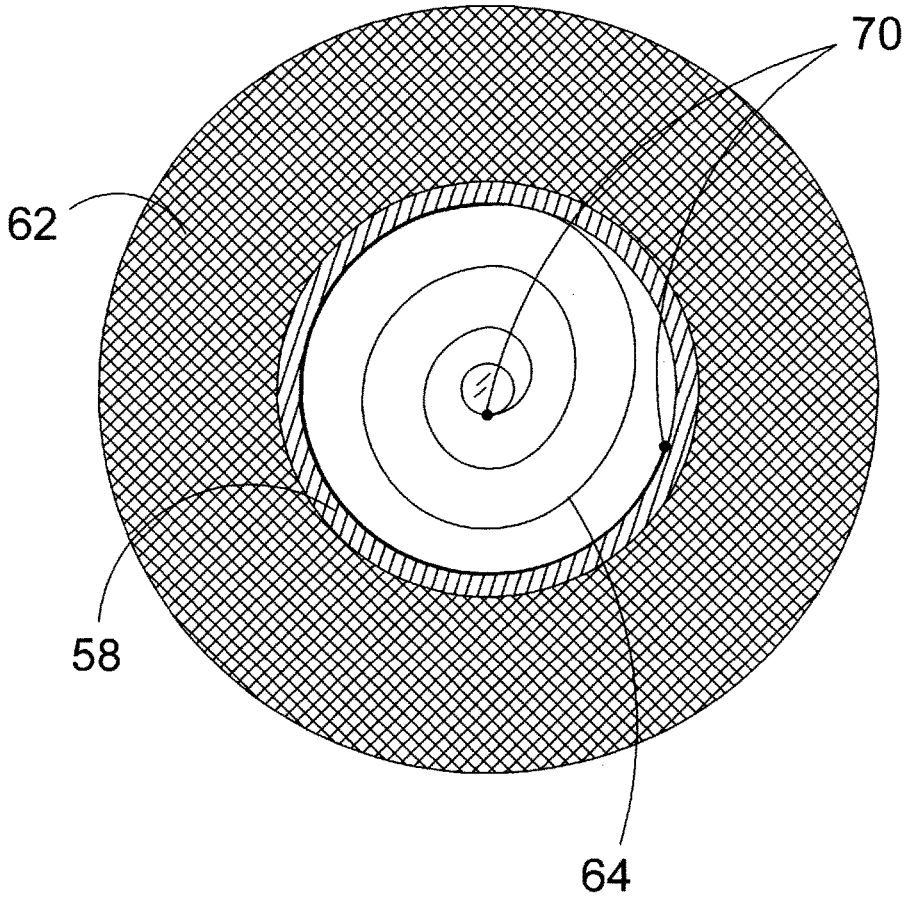
FIG. 6 is a cutaway view of a coiled spring enablement of a screen tensioning member; and, FIG. 7 is an elevational view of screen deploying sash of the present invention.

FIG. 6 is a cutaway view of a coiled spring enablement of a screen tensioning member. Shown is screen holder 58 having screen 62 with screen tensioner 64 anchored between a non-rotative housing member and holder 58.

Figure 7:
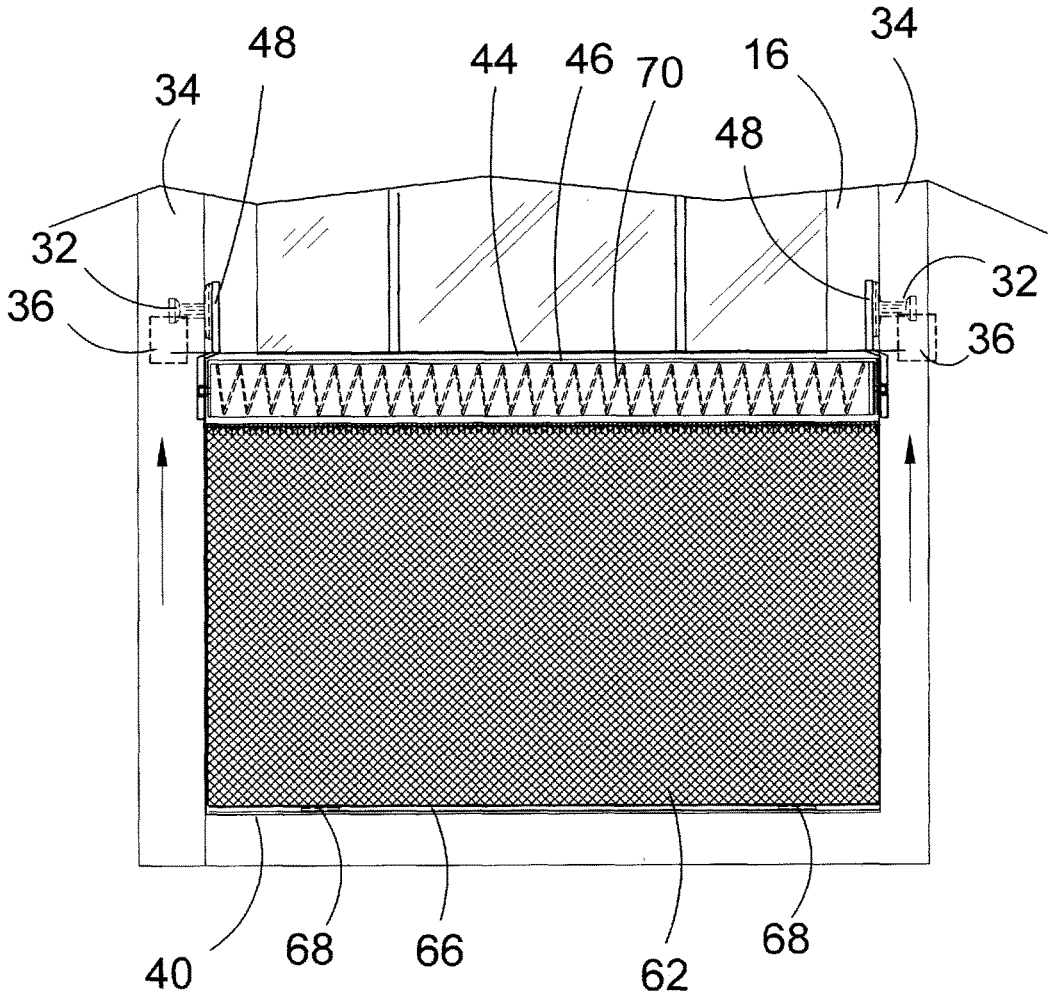

FIG. 7 is an elevational view of screen deploying sash of the present invention. Illustrated is a tilt window 10 comprising sash 16 having sill 40, screen module 44 housing screen 62 and screen anchor 66. With screen anchor 66 releasably fastened to sill 40, screen 62 is deployed from holder 52 with the screen tensioner 64 comprising a longitudinal spring storing the pressure from the deployed screen until the sash is lowered.

What is claimed is:

1. A window sash, comprising;

a screen module; and, a pair of spaced apart stiles and rails conjoined on their distal ends with at least one of the rails having a receptacle receiving the screen module, said screen module comprising a housing having a base with a longitudinal slot and a screen brush positioned approximate the longitudinal slot for engaging a screen to remove debris while passing through the slot for mounting the screen on a holder, said holder having an anchored end and a free end with the free end releasably latchable to a window sill, thereby deploying and retracting the screen as the sash is raised said holder having a tensioning member storing pressure for deploying the screen and then used to retract the screen as the sash is raised and lowered.

2. The window sash according to claim 1, further comprising a distal end housing bracket securing the screen module with the window sash.

3. The window sash according to claim 1, wherein the screen brush is mounted to an interior wall of the slot brushing debris from the screen when passing.

4. The window sash according to claim 1, wherein said brush includes a polymeric or elastomeric blade that is fixed approximate the slot engaging the screen as the screen deploys and retracts.

5. The window sash according to claim 1, wherein the holder tensioning member is a longitudinal spring anchored to the holder with the holder having a rotative holder component and the housing having a non-rotative housing component.

6. The window sash according to claim 1, wherein the holder tensioning member is a coiled spring anchored to the housing having a non-rotative housing component and the holder having a rotative holder component.

* * * * *